United States Patent [19]

Estes

[11] Patent Number: 5,074,367

[45] Date of Patent: Dec. 24, 1991

[54] ROCK BIT WITH IMPROVED SHANK PROTECTION

[75] Inventor: Roy D. Estes, Weatherford, Tex.

[73] Assignee: Rock Bit Industries, Inc., Ft. Worth, Tex.

[21] Appl. No.: 522,106

[22] Filed: May 11, 1990

[51] Int. Cl.[5] ..... E21B 10/36; E21B 10/52

[52] U.S. Cl. ..... 175/374; 175/332; 175/408; 175/410; 175/415

[58] Field of Search ..... 175/331, 336, 408, 415, 175/410, 332, 309, 374, 332

[56] References Cited

U.S. PATENT DOCUMENTS

| | | | |
|---|---|---|---|
| 3,120,285 | 2/1964 | Rowley et al. | 175/408 |
| 3,130,801 | 4/1964 | Schumacher, Jr. | 175/374 |
| 3,134,447 | 5/1964 | McElya et al. | 175/332 |
| 3,628,616 | 12/1971 | Neilson | 175/408 X |
| 4,068,731 | 1/1978 | Garner et al. | 175/408 X |
| 4,630,694 | 12/1986 | Walton et al. | 175/408 X |
| 4,936,398 | 6/1990 | Auty et al. | 175/336 |

*Primary Examiner*—Stephen J. Novosad

[57] ABSTRACT

An improved rotary rock bit is described having a plurality of wear resistant inserts protruding along the leading edge of the bearing segment shanks. These inserts break up large chunks of formation which protrude inward from the borehole wall while drilling fractured or broken hard formations. Thereby protecting the bit from damage and excessive erosion often incurred while drilling hard fractured and broken formations.

3 Claims, 2 Drawing Sheets

FIGURE 1
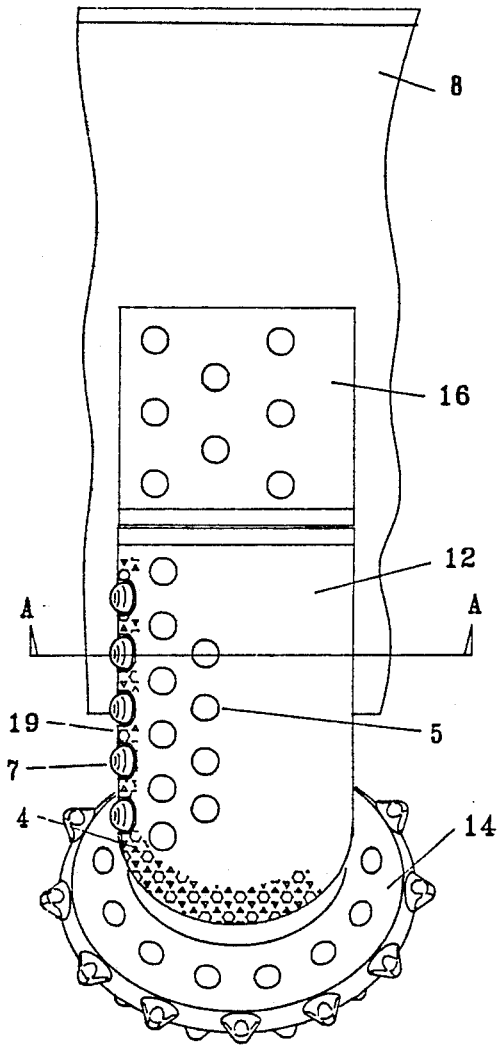
FIGURE 2
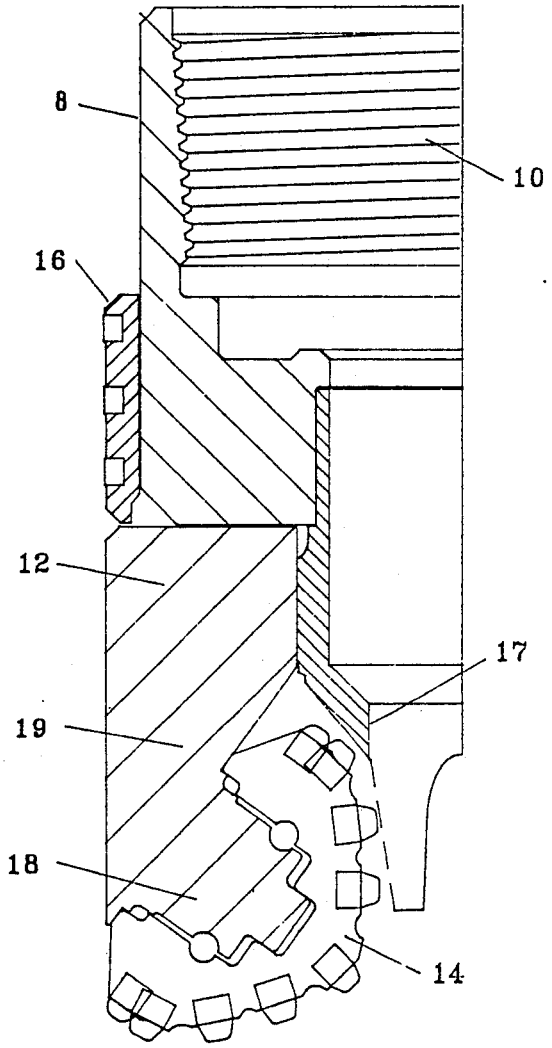
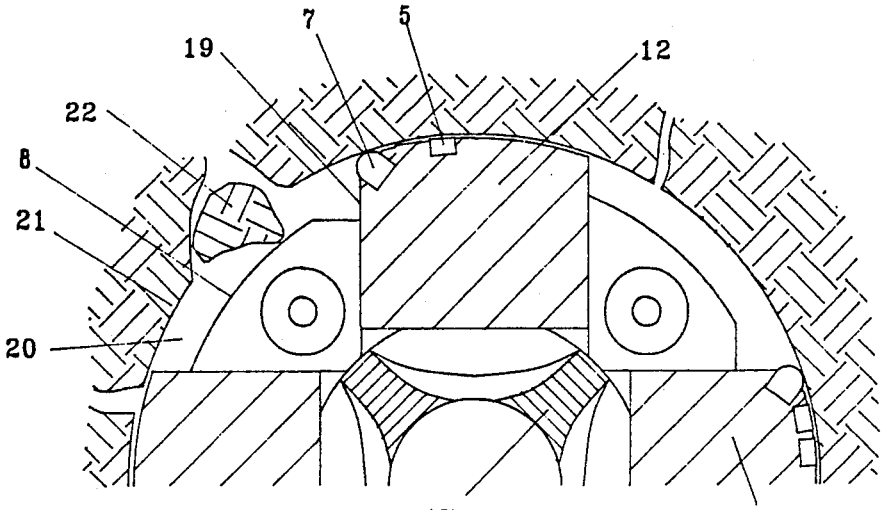
FIGURE 3

ROCK BIT WITH IMPROVED SHANK PROTECTION

FIELD OF INVENTION

This invention relates generally to earth boring bits used in drilling in oil field and mining applications and particularly to improved bits which are better able to resist side wear from abrasive fractured and broken formations.

BACKGROUND OF INVENTION

In the rotary drilling of boreholes in earth formations, a drill bit is connected to the lower end of a hollow drill string which is lowered and rotated to cause the bit cutters to dislodge particles or cuttings from the hole bottom. Usually these bits have two or more shanks depending from a bit body and each shank supports a rotatably mounted cone cutter which faces toward the center of the borehole. A drilling fluid such as gas or liquid is circulated downwardly through the drill string and up the wall of the borehole to remove cuttings.

In drilling some of the hard abrasive formations, zones may be encountered where the formation is badly fractured and loose chunks may be left in the borehole wall as the bit drills through the zone.

These chunks are free to move and intrude into the borehole between the borehole wall and bit and cause wear and damage to the shanks or legs of the bit just above the cutters.

The presence of such zones have been noted in the Ocean Drilling Program. The Ocean Drilling program is a multinational geophysical research project. Core samples are taken from the ocean floor for analysis using techniques and equipment common to the oil and mining industries. Severe damage to their core bits occurred when they encountered badly fractured basaltic formations. The leading edges and outer surfaces of the shanks were worn away to the extent that o-rings protecting the cone bearing systems were exposed and destroyed causing premature bearing failure Some shanks were worn thin enough to cause shank breakage resulting in cone and bearing assemblies being left in the borehole. These assemblies had to be "fished" out of the borehole before drilling could continue.

Other instances of similar problems have occurred in drilling blast holes in taconite mines where the formation has been badly fractured from previous blasts. Large loose rock fragments falling in from the borehole wall against the bit as it rotates cause wear and damage to the shanks of rotary cone bits.

Rotary percussion bits which are also commonly used in the mining industry to drill blast holes experience similar wear and damage to the sides of the bit heads when drilling hard broken formations. This excessive wear on the sides of the head often lead to premature loss of the gage cutting inserts.

In previous attempts to address this problem in rotary cone mining bits, hardfacing pads and flat-top tungsten carbide inserts were placed in the shanks to minimize abrasive wear and damage. This was successful to a limited degree. Another method was tried unsuccessfully in which carbide balls were placed in a raceway on the shank and allowed to rotate as described in the Schumacher U.S. Pat. No. 3,130,801.

In the case of percussion bits, inserts were installed in the sides of the bits above each gage insert. This reduced the erosion of steel from above the gage inserts and extended the useful life of the bits.

SUMMARY OF THE INVENTION

A general object of this invention is to provide an improved protection for the shanks or sides of the rock bit.

Another object is to provide an improved rock bit having protruding inserts, i.e. conical, rounded, wedge shaped, etc., placed in the leading edge of shank or leg, with the points exposed to engage any formation that has intruded into the hole.

Other objects will become apparent from the following description and accompanying drawings.

BRIEF DESCRIPTION OF THE DRAWINGS

FIG. 1 is a side view of one shank of a four cone rotary core bit with the preferred embodiment;

FIG. 2 is a view of a vertical section through the bit of FIG. 1;

FIG. 3 is a view of a horizontal section through the bit of FIG. 1;

DESCRIPTION OF THE PREFERRED EMBODIMENT

Figure 4:
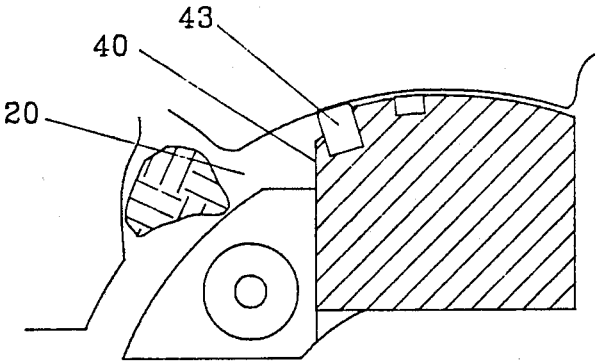
FIG. 4 is a view of a horizontal section of a shank illustrating another embodiment.

FIGS. 1,2, and 3 illustrate views of a four cutter rolling cone core bit with the preferred embodiment of this invention. The bit body 8 has a box thread 10 for securing to a suitable core barrel. Secured to the body 8 is bearing segment 12 with its cone 14, a wear pad 16 and a core guide 17. The bearing segment 12 consist of a bearing 18 and shank 19.

Torch applied hardfacing 4 along the leading and lower edge of shank 19 and an array of flat topped inserts 5 on the outer most surface are shown on bearing segment 12 in FIG. 1. ("Leading edge" refers to the edge of a particular part which is facing the direction of rotation). Flat topped inserts 5 generally have little if any portion of the insert protruding above the surrounding surface. They are designed primarily to resist wear rather than to break formation. In prior art this was the only form of protection used to control erosion of the bearing segment shank. This invention provides a series of shaped inserts 7 mounted along the leading edge of the shank 19. Shaped inserts, as opposed to flat inserts, have relatively pointed protrusions which extend above the surrounding surface when installed. These protrusions can be hemispherical, conical, ogive, chisel shaped, etc . . . These protrusions are intended to make point contact with formation so as to break the formation. As shown in FIG. 3 these shaped inserts 7 are installed in the leading edge of shank 19 and are inclined at an angle so that the point of the protrusion is facing relatively toward the direction of rotation. Large chunks of hard abrasive formation 22 which fall into the space 20 between the hole wall 21 and body 8 are broken up by these inserts 7 into particles small enough to be removed by the drilling fluid.

Many core bits such as illustrated here were studied. After drilling certain hard fractured formations it was common to have early bit failures with severe erosion to the shanks 19 just above the cones 14. This erosion resulted in weakened and broken shanks and exposed and failed cone bearing seals. It was suggested that the problem was caused by large chunks of formation 22, as shown in FIG. 3, formed and trapped in the borehole wall. These chunks 22 were too large to be removed by drilling fluid through the space between the body 8 and borehole wall 21. They would fall inboard against the bit and cause severe erosion as they were crushed between the bit shanks 19 and borehole wall 21. Torch applied hard metal 4 and flat inserts 5 help protect against normal erosion due to large cuttings and detritus but they were not efficient in breaking and crushing large chunks. The large chunks would eventually be broken up but they caused severe wear, erosion and damage to the bit in the process.

The use of hard metal inserts 7 along the leading edges of the shanks has resulted in substantially improved core bit life in hard, fractured abrasive formations. The dull bits with this added protective feature have had much less wear and damage to the shanks.

The shaped, hard wear resistant inserts used in this embodiment were made of sintered tungsten carbide. There are other wear resistant materials which could function suitably and probably there will be better materials for use in this invention in the future. In the embodiment shown in FIG. 3 the inserts 7 are rigidly affixed to the leading edge of the shank 19. They are retained by an interference fit into receiving apertures. They could have been rigidly affixed by other means such as silver solder or braze. The inserts 7 are also set at a cocked angle so that the insert 7 is angled toward the direction of rotation. The angle makes the insert function more efficiently and allows adequate metal to surround the receiving aperture.

Another embodiment of this invention is shown in a similar bit in FIG. 4. While shaped inserts are preferred it is possible to design this invention to make use of less expensive cylindrical flat topped inserts. In this variation material from the leading edge of shank 40 has been removed to expose an adequate portion of the leading side of the cylindrical flat topped insert 43. This will provide much the same protection as the preferred embodiment. The exposed leading edge of insert 43 effectively provides point contact of the insert to large chunks of formation, breaking these chunks in essentially the same manner as the protruding inserts previously discussed. In either case large chunks of formation which get trapped in the clearance area 20 preceding the shank will be broken by exposed wear resistant inserts mounted along the leading edge of the shank.

The application of this invention has been described thus far on rolling cone core bits where it was used first. This invention will also be useful cone on more conventional bits such as three cone rotary rock bits, two cone rotary rock bits and percussion rotary hammer bits all of which are used in mining and oil field applications and are well known in the art of earth boring.

Figure 5:
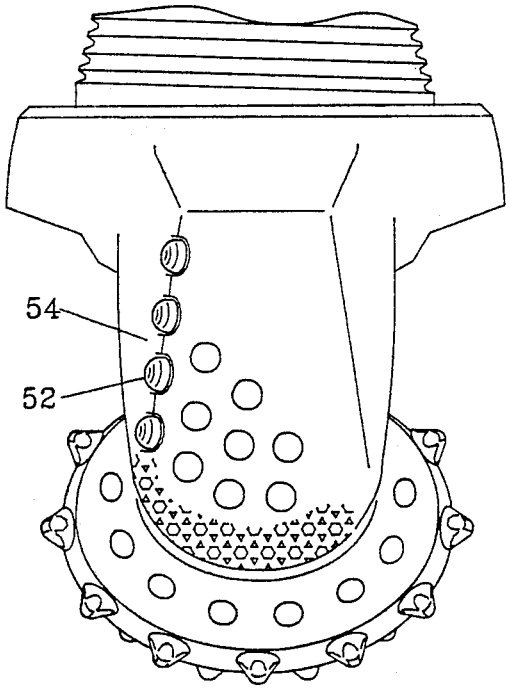
FIG. 5 is a side view of one segment of a tri-cone rotary rock bit having this invention.
Figure 6:
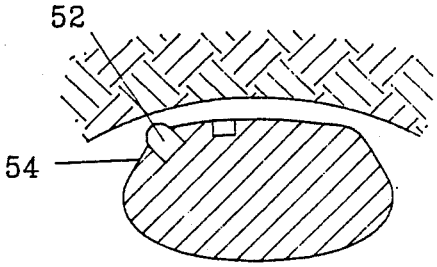
FIG. 6 is a view of a horizontal section through the shank in FIG. 5.

FIGS. 5 and 6 illustrate a portion of a three cone rotary rock bit improved with this invention. A series of shaped wear resistant inserts 52 are secured in receiving apertures along the leading edge of shank 54.

Shank protection inserts 7 may be placed on gage as in FIG. 3 for the additional benefit of maintaining the borehole gage diameter longer. The shanks of most tricone rotary rock bits taper inboard slightly toward the pin end. This causes the shank protecting inserts 52 to be somewhat inboard of gage. It would enhance the effect of this invention on tricone bits to modify the shanks such that the shank protection inserts were on gage.

Figure 7:
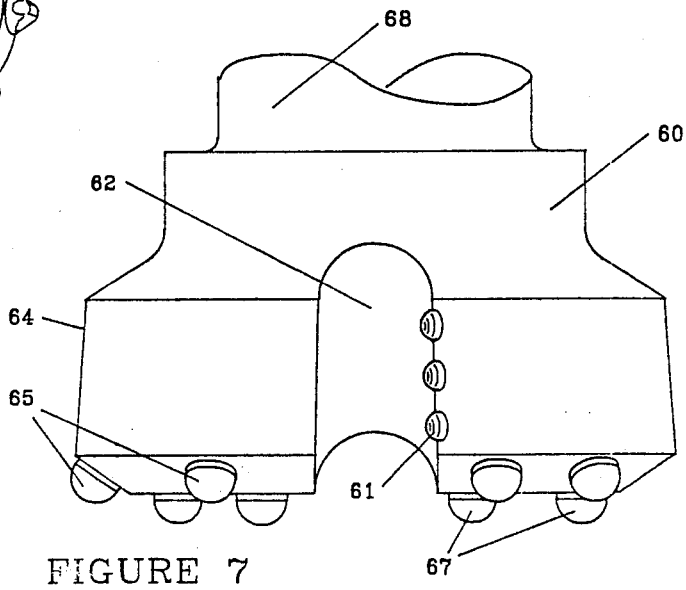
FIG. 7 is a view of a rotary percussion hammer having this invention.

FIG. 7 illustrates this invention on a percussion rotary bit. Since the rotary bit stem which fits into the percussion hammer is not pertinent to this invention only the base of stem 68 extending above bit head 60 is shown in FIG. 7. The percussion bit head 60 having gage inserts 65 and face inserts 67 has chipways (or flutes) 62 cut into the shirt (or side) 64. A series of shaped inserts 61 are secured along the trailing edge of chipway 62. These inserts 61 break up large chunks of fractured formation which dislodge from the hole wall and protrude against the bit skirt. This retards skirt erosion and premature loss of gage inserts due to loss of the metal retaining those inserts.

Some improvements in percussion bit life have previously been obtained by torch application of hard metal to the skirts and by installing shaped inserts vertically above each gage insert.

There are various embodiments within the scope of this invention which will become apparent to those skilled in the art.

What I claim is:

1. An improved rotary cone earth boring bit having two or more depending bearing segments; each said segment consisting of a shank terminating in a bearing depending downwardly and inwardly from said shank; having rolling cone cutters rotatably mounted on each said bearing; each said shank having an outermost leading edge relatively facing the direction of bit rotation; the improvement being:

a plurality of hard wear resistant inserts rigidly secured in said outermost leading edge of said shank; and said inserts having protrusions facing relatively toward the direction of normal bit rotation.

2. An improved rotary cone earth boring bit having two or more depending bearing segments; each said segment consisting of a shank terminating in a bearing depending downwardly and inwardly from said shank; having rolling cone cutters rotatably mounted on each said bearing; each said shank having an outermost leading edge relatively facing the direction of bit rotation; the improvement being:

a plurality of cylindrical relatively flat topped wear resistant inserts rigidly secured in the outermost leading edge of said shank; said inserts secured such that the outer leading cylindrical sides of said inserts are exposed.

3. An improved rotary percussion bit having a stem and a head section; said head section having a plurality of wear resistant inserts for crushing and breaking earth formations, said head section having a plurality of chipways around its perimeter, each said chipway having a trailing edge and a leading edge; the improvement being:

a plurality of hard wear resistant inserts rigidly secured along the trailing edge of one or more of said chipways.

* * * * *